United States Patent [19]

Borsoi

[11] Patent Number: 4,615,128

[45] Date of Patent: Oct. 7, 1986

[54] SKI BOOT INCORPORATING A FLEX CONTROL DEVICE

[75] Inventor: Bruno Borsoi, Conegliano Veneto, Italy

[73] Assignee: Nordica S.p.A., Montebelluna, Italy

[21] Appl. No.: 693,632

[22] Filed: Jan. 22, 1985

[30] Foreign Application Priority Data

Jan. 25, 1984 [IT] Italy ..... 19316 A/84

[51] Int. Cl.[4] ..... A43B 5/04

[52] U.S. Cl. ..... 36/120; 403/4

[58] Field of Search ..... 36/117–121, 36/105; 403/4

[56] References Cited

U.S. PATENT DOCUMENTS 3,885,329 5/1975 French ..... 36/120
4,334,368 6/1982 Chalmers, II et al. ..... 36/121

FOREIGN PATENT DOCUMENTS 2807371 8/1979 Fed. Rep. of Germany ..... 36/121
3319749 12/1983 Fed. Rep. of Germany ..... 36/117

*Primary Examiner*—James Kee Chi
*Attorney, Agent, or Firm*—Guido Modiano; Albert Josif

[57] ABSTRACT

The flex control device comprises a pin element associated with the ski boot shell and extending through an elongate aperture formed in an impression defined on the leg portion or lining quarter. Receivable in the cited impression is a small shaped plate having a slot to allow said pin element therethrough. The device further includes a means for releasably locking said small shaped plate in a first position wherein the slot is aligned with the elongate aperture, for a combined rotary and sliding movement between the leg portion or lining quarter and shell, and in a second position wherein the slot extends crosswise to the elongate aperture.

12 Claims, 7 Drawing Figures

SKI BOOT INCORPORATING A FLEX CONTROL DEVICE

BACKGROUND OF THE INVENTION

This invention relates to a ski boot incorporating a flex control device.

As is known, ski boots comprise, in their commonest embodiment, a shell arranged to embrace the user's foot, to which shell a quarter is connected which substantially encircles the user's ankle region, irrespective of whether it is a so-called rear entry or front entry ski boot.

As is known in the manufacture of ski boots, it is necessary to allow for a limited relative movement between the shell and the quarter in order to permit a correct skiing action.

The extent and type of that movement practically affect the ski boot flexing characteristics, which characteristics require to be changed each time according to the skier's own requirements and preferences, as well as to the skiing performance sought.

Currently available solutions for controlling the amount of flex in a ski boot are generally considerably complicated and inadequately functional because they do not allow the user to change the ski boot flexing characteristics in a quick and simplified manner.

Another disadvantage of prior solutions is that, as a rule, flex control is achieved through a large number of component parts which are complicated and expensive to assemble.

SUMMARY OF THE INVENTION

It is the aim of this invention to obviate such prior disadvantages by providing a ski boot incorporating a flex control device, which enables the type and characteristics of the relative movement between the two mutually movable parts of the boot to be varied such as to afford flex control capabilities.

Within the above aim, it is a particular object of the invention to provide a device which is simple construction-wise and of low cost, while posing no assembling problems or difficulties.

A futher object of this invention is to provide a device which so constructed as to undergo no alterations of its operating features due to thermal ranges to which a ski boot would be normally subjected.

A not unimportant object of this invention is to provide a device which may be incorporated to any boot types, whether of the front or rear entry types, while retaining its functionality even with different applications.

This aim, as well as these and other objects such as will be apparent herein below, are achieved by a ski boot incorporating a flex control device, according to the invention, characterized in that it comprises, between at least two mutually movable parts of a ski boot, a pin element associated with either of said parts and extending through an elongate aperture formed in an impression defined on the other of said parts, removably receivable in said impression being a small shaped plate provided with a slot for said pin element to pass therethrough, also provided being a means for releasably locking said small shaped plate in at least one first position, wherein the slot is aligned with the elongate aperture, and at least one second position, wherein said slot extends crosswise to said elongate aperture.

BRIEF DESCRIPTION OF THE DRAWINGS

Further features and advantages will be more readily understood from the following description of a preferred, but not exclusive, embodiment of a ski boot, with reference to the accompanying illustrative, but not limitative, drawings, where.

DESCRIPTION OF THE PREFERRED EMBODIMENTS

Figure 1:
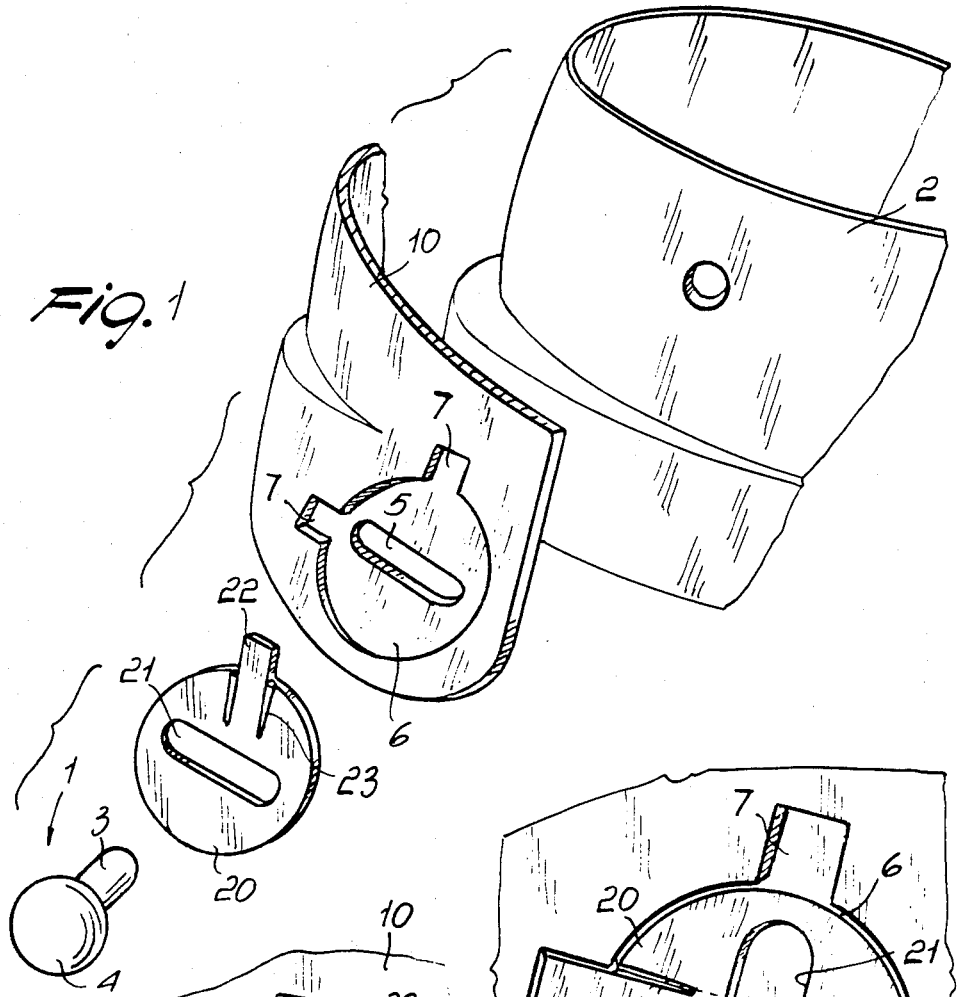
FIG. 1 is an exploded perspective, detail view showing diagramatically this flex control device.

With reference to the drawing views, a ski boot incorporating a flex control device, according to the invention, comprises a pin element, generally indicated at 1, which is associated with either of the two mutually movable parts of a ski boot between which the device would be mounted.

In this specific instance, the pin element 1 is associated with the shell 2 of a ski boot.

More detailedly, the pin element 1 includes a shank 3 which may be riveted or otherwise associated with the shell 2 and has an enlarged head 4.

The cited pin element 1 is passed through an elongate aperture 5 formed through an impression 6 provided on the other of the mutually movable parts of a ski boot, and specifically on the leg portion or lining quarter 10 thereof.

In a preferred embodiment, given herein by illustration only, the impression 6 has a substantially circular configuration and is provided with a pair of radial seats 7 formed peripherally to extend in two orthogonal directions to each other.

Said impression 6 may accommodate a small shaped plate 20, of circular configuration to match the impression 6 which has a slot, or elongate center slot 21.

The small plate 20 is further provided peripherally with a radial lug 22 having, at the area of attachment to the plate, notches 23 which impart to it adequate elasticity to permit of the lug being lifted. The lug 22 is removably receivable in the radial seats 7 for locking the small shaped plate 20 at a present location in the impression 6.

Figure 2:
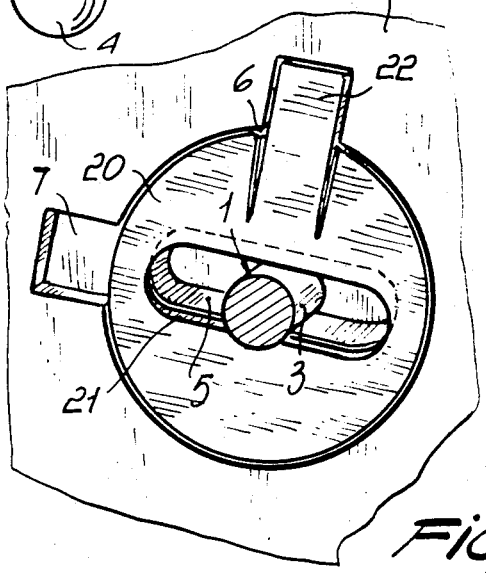
FIG. 2 shows diagramatically the device with the small plate in its first position.
Figure 3:
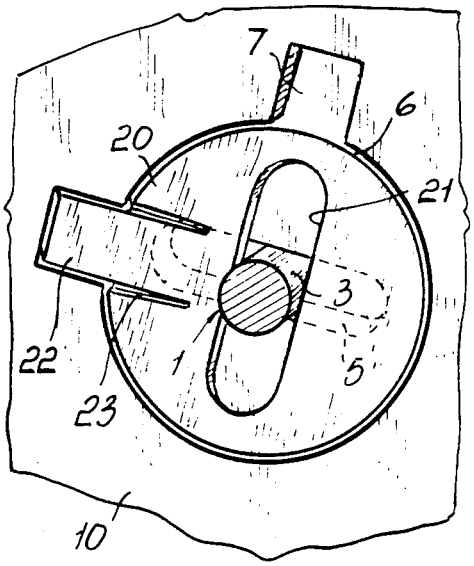
FIG. 3 shows the device with the small plate in its second position.

By positioning the small shaped plate at its first operating location, as shown in FIG. 2, the slot 21 is aligned with the elongate aperture 5, thereby given the fact that the pin 1 can slide within both the elongate aperture 5 and the slot 21, the quarter is allowed to both turn and translate relatively to the shell, thus increasing the ski boots' flexing ability.

by positioning the small shaped plate 20 at its second location, the slot 21 is arranged to extend substantially perpendicularly to the elongate aperture 5, thereby the relative movement of the quarter and shell is merely restricted to a mutual rotational movement.

It should be further added that the shank 3 of the pin 1, preferably has a diameter substantially equal to the width of the elongate aperture 5 and the slot 21, which have the same size.

Figure 4:
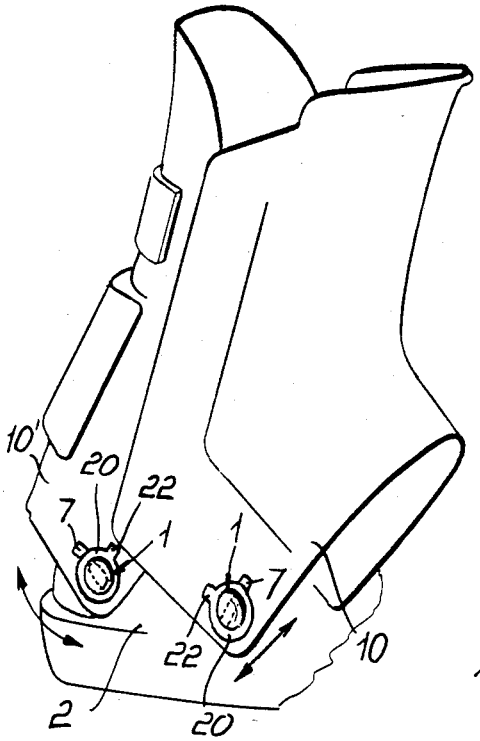
FIG. 4 shows diagramatically the device as applied to the articulation area of the quarters of a rear entry boot.
Figure 5:
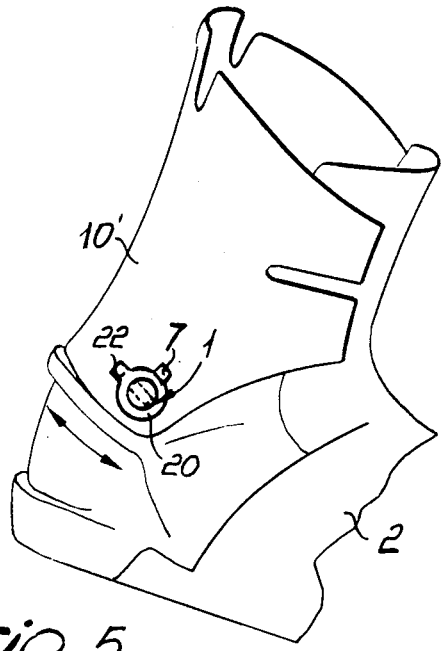
FIG. 5 shows the device as applied to the articulation area of the quarter of a front entry boot.

As shown in FIGS. 4 to 7, the device may be mounted at various locations on the ski boot; thus, as an example, the device of this invention is shown in FIG. 4 to be connected, at the articulation area of the shell quarters 10, 10', to the shell 2 in the instance of a rear entry boot, whereas in FIG. 5, it is connected to the bottom side portion of the rear quarter 10' of a front entry ski boot.

Figure 6:
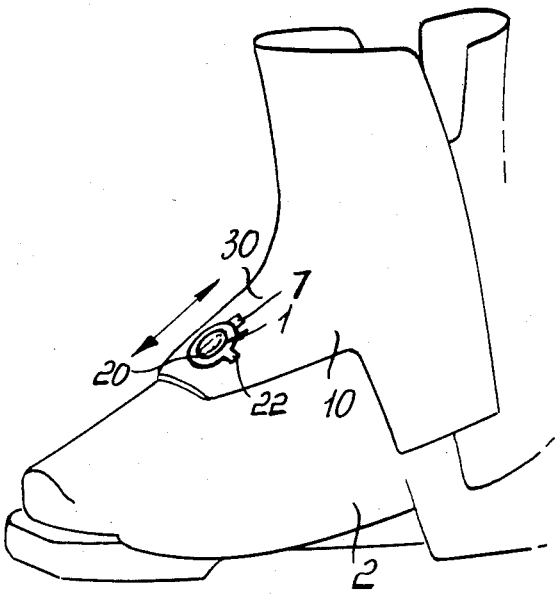
FIG. 6 shows the device as applied to the front of a boot quarter.

In FIG. 6, the device is provided at the front protuberance 30 of a front quarter 10 of a rear entry ski boot quarter, thus affording a mutual sliding movement feature where both the slot and the elongate aperture are in alignment, whereas with the slot 21 arranged perpendicularly to the elongate aperture 5, that movement would be inhibited.

Figure 7:
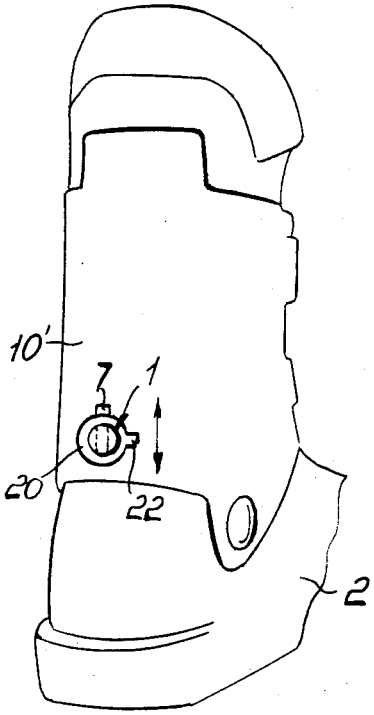
FIG. 7 shows the device as applied to the rear of a ski boot.

Similarly, the device may be attached, as shown in FIG. 7, to the rear portion of a rear quarter 10'.

It should be also added to the foregoing that the small shaped plate change of position can be effected very quickly and simply; in fact, it will be sufficient to so lift the radial lug 21 as to disengage it from the seat 7 housing it and turn the plate to fit the lug into the other seat 7.

Of course, where required, several seats 7, variously scattered along the circumference of the impression 6, may be provided to provide intermediate positions.

It may be appreciated from the foregoing description that the invention achieves its objects. and in particular that the device affords the faculty of changing the type of mutual movement between the shell and quarter of a ski boot, consequently varying the flexibility of the boot, without any complex or tedious operations.

Furthermore, attaching the device is quite a simple matter because it will be sufficient to install the pin element 1 after the quarter and small shaped plate have been arranged correspondingly.

The invention as disclosed is susceptible to many modifications and changes without departing from the purview of the inventive concept.

All of the details, moreover, may be replaced with other technically equivalent elements.

In practicing the invention, any materials, shapes and dimensions, may be used contingent on requirements.

I claim:

1. A ski boot incorporating a flex control device, said ski boot including at least two mutually movable juxtaposed surface portions lying substantially parallel to a common plane, said flex control device comprising a pin element associated with one of said mutually movable surface portions, an impression defined on another of said mutually movable surface portion, an elongate aperture formed in said impression, a shaped plate, a slot formed in said shaped plate, and locking means, said shaped plate being removably receivable in said impression with said slot overlying said elongate aperture, said pin element extending substantially orthogonally to said common plane through said elongate aperture and said slot, said locking means being adapted for releasably locking said small shaped plate in at least a first position and a second position in said impression for selectively controlling relative movement between said mutually movable surface portions in directions substantially parallel to said common plane.

2. A ski boot incorporating a flex control device according to claim 1 wherein said shaped plate is adapted for being selectively locked in said first position wherein said slot is aligned with said elongate aperture for permitting said pin element to both rotate in and slide along said slot and said elongate slot to allow said mutually movable surface portions to be mutually rotationally and linearly displaced in said directions extending parallel to said common plane.

3. A ski boot incorporating a flex control device according to claim 1 wherein said shaped plate is adapted for being selectively locked in a second position wherein said slot extends transverse to said elongate aperture for preventing said pin element from sliding along said slot and said elongate slot and permitting said pin element to rotate in said slot and said elongate slot to allow said mutually movable surface portions to be mutually rotationally displaced in said directions extending parallel to said common plane.

4. A ski boot incorporating a flex control device according to claim 1 wherein said impression is a circular impression having an internal diameter and said shaped plate is a circular shaped plate defining an external diameter, substantially corresponding to said internal diameter of said impression.

5. A ski boot incorporating a flex control device according to claim 4 wherein said circular shaped plate is rotationally displaceable in said impression.

6. A ski boot incorporating a flex control device according to claim 1 wherein said locking means comprise at least two seats formed peripherally in said impression, and at least one lug resiliently associated with said shaped plate, said at least one lug being selectively removably insertable in said seats.

7. A ski boot incorporating a flex control device according to claim 6 wherein said lug defines an area of attachment to said shaped plate, said area of attachment being formed with flanking notches, said flanking notches being adapted for imparting elasticity to said lug for facilitating withdrawal of said lug from said seats.

8. A ski boot incorporating a flex control device according to claim 1 wherein said mutually movable surface portions are comprised in a ski boot shell and a ski boot quarter, said impression beind defined on said quarter.

9. A ski boot incorporating a flex control device according to claim 1 wherein said mutually movable surface portions are comprised in a ski boot shell and a ski boot quarter, an articulation area being defined between said shell and said quarter, said shaped plate being installed at said articulation area.

10. A ski boot incorporating a flex control device according to claim 1 wherein said mutually movable surface portions are comprised in a front portion of a ski boot shell and a front protuberance of a ski boot quarter, said shaped plate being installed between said front protuberance of said ski boot quarter and said front portion of said ski boot shell.

11. A ski boot incorporating a flex control device according to claim 1 wherein said mutually movable juxtaposed surface portions pertain to a rear portion of a ski boot shell and a ski boot rear quarter, said shaped plate being installed between said rear portion of said ski boot shell and said ski boot rear quarter.

12. A ski boot incorporating a flex control device, said ski boot including at least two mutually movable juxtaposed surface portions lying substantially parallel to a common plane, said flex control device comprising a pin element associated with one of said mutually movable surface portions, a circular impression having an internal diameter and being defined on another of said mutually movable surface portions, an elongate aperture formed in said circular impression, a circular shaped plate defining an external diameter substantially corresponding to said internal diameter of said circular impression, a slot formed in said circular shaped plate, at least two seats formed peripherally in said impression, at least one lug resiliently associated with said circular shaped plate, said circular shaped plate being removably, rotatably accommodatable in said circular impression with said slot overlying said elongate aperture, said pin element extending from said one of said mutually movable surface portions along a direction substantially orthogonal to said common plane and passing through said aperture and said slot, said lug being selectively removably insertable in said seats for releasably locking said circular shaped plate in at least a first position whereat said slot is aligned with said elongate aperture and a second position whereat said slot extends transverse to said elongate aperture.

* * * * *